US005354636A

United States Patent [19]

Ono et al.

[11] Patent Number: 5,354,636

[45] Date of Patent: Oct. 11, 1994

[54] ELECTROPHOTOGRAPHIC PHOTORECEPTOR COMPRISING POLYIMIDE RESIN

[75] Inventors: Yoshiyuki Ono; Masaki Yokoi; Kazuo Yamasaki; Hiroyuki Hotta, all of Minami-ashigara; Kenichi Kobayashi, Ebina; Takayuki Yamada, Ebina; Hitoshi Kojima, Ebina, all of Japan

[73] Assignee: Fuji Xerox Co., Ltd., Tokyo, Japan

[21] Appl. No.: 836,424

[22] Filed: Feb. 18, 1992

[30] Foreign Application Priority Data

Feb. 19, 1991 [JP] Japan ..... 3-045446
Feb. 21, 1991 [JP] Japan ..... 3-047359

[51] Int. Cl.[5] ..... G03G 5/07

[52] U.S. Cl. ..... 430/78; 430/56; 430/59; 430/96

[58] Field of Search ..... 430/96, 58, 78, 76, 430/56

[56] References Cited

U.S. PATENT DOCUMENTS 3,554,744 1/1971 Maas ..... 96/1.5
4,419,427 12/1983 Graser et al. ..... 430/58
4,514,482 4/1985 Loutfy et al. ..... 430/78
4,517,270 5/1985 Graser et al. ..... 430/58
5,077,161 12/1991 Law ..... 430/59
5,266,429 11/1993 Sorrieto et al. ..... 430/58

FOREIGN PATENT DOCUMENTS 43-24754 10/1968 Japan ..... 430/78
57-176046 10/1982 Japan .
57-176047 10/1982 Japan .
1-214867 8/1989 Japan .
2-37356 2/1990 Japan .

*Primary Examiner*—Marion E. McCamish
*Assistant Examiner*—Rosemary Ashton
*Attorney, Agent, or Firm*—Oliff & Berridge

[57] ABSTRACT

An electrophotographic photoreceptor comprising a conductive substrate having provided thereon a photoconductive layer is disclosed, said photoconductive layer containing a high polymeric compound comprising a repeating unit comprised of a tetracarboxylic acid anhydride skeleton and a divalent organic group skeleton having an aromatic nucleus, said two skeletons being bonded via a nitrogen atom. Said high polymeric compound is formed by co-deposition of a tetracarboxylic acid anhydride compound and an aromatic diamine compound. The photoreceptor exhibits high sensitivity, high durability, and excellent image quality retention even when used repeatedly or in a high humidity environment.

1 Claim, 1 Drawing Sheet

FIGURE
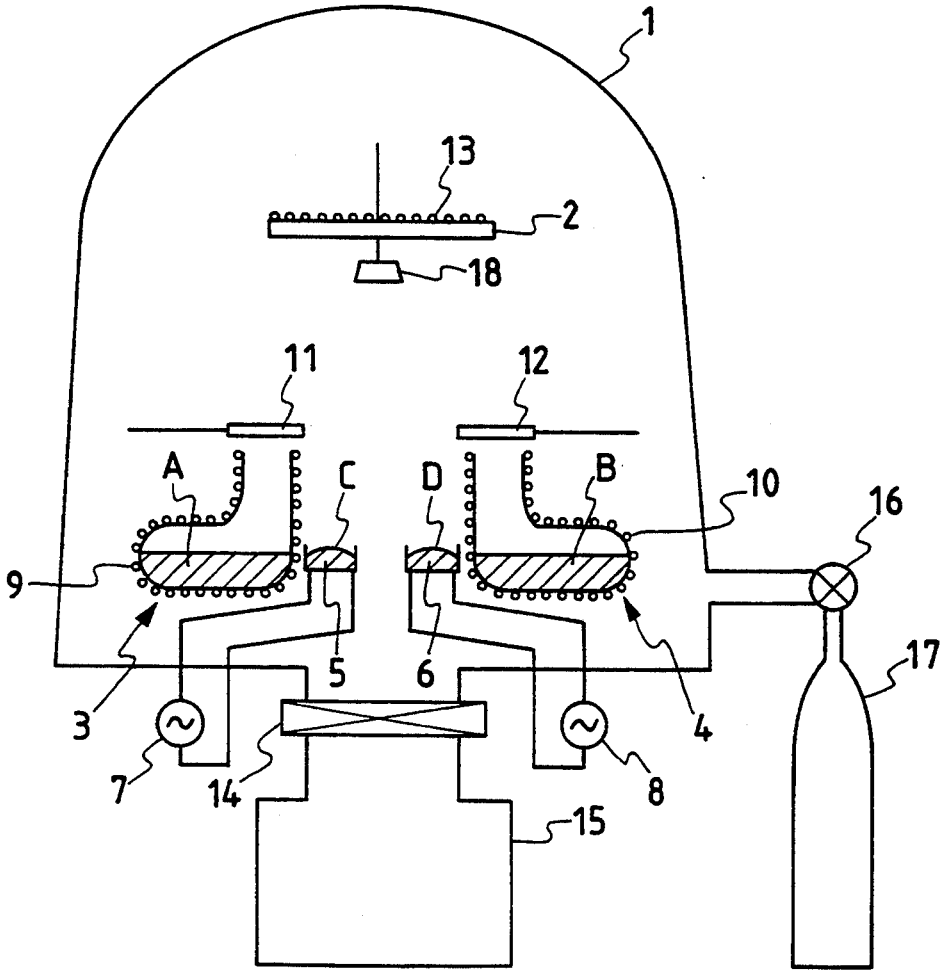

ELECTROPHOTOGRAPHIC PHOTORECEPTOR COMPRISING POLYIMIDE RESIN

FIELD OF THE INVENTION

This invention relates to an electrophotographic photoreceptor for use in electrophotographic copying machines and photo printers and a process for producing the same. More particularly, it relates to an electrophotographic photoreceptor containing a high polymeric compound.

BACKGROUND OF THE INVENTION

Generally known electrophotographic photoreceptors are comprised of chalcogenide glass, amorphous silicon, and organic photoconductive materials. With attention to a wide selection of organic photoconductive materials, a number of organic electrophotographic photoreceptors have recently been proposed. In particular, many of so-called separate functional type organic photoreceptors composed of a charge generating layer and a charge transporting layer have excellent characteristics. The charge transporting layer of separate functional type organic photoreceptors has been formed by a coating method in which a coating composition containing a charge transporting material, e.g., hydrazone derivatives, and a binder resin, e.g., polycarbonate resins, dissolved in an appropriate solvent is coated on a substrate by dip coating, wire bar coating, spray coating, or a like coating technique followed by drying.

However, the wet process coating method is liable to induce incorporation of impurities into a coating film, and the solvent of the coating composition is apt to remain to adversely affect electrophotographic characteristics and image quality retention properties. Further, the coating method is attended by a difficulty in film thickness control, often failing to form a charge transporting layer of uniform thickness.

For the purpose of avoiding these disadvantages of the coating method, a deposition method has been suggested, in which a charge transporting layer containing polyimide as a binder resin and an eutectic crystal of tetracyanoquinone and tetrathiofulvalene is formed by deposition polymerization, as disclosed in JP-A-1-214867 (the term "JP-A" as used herein means an "unexamined published Japanese patent application").

In using the deposition polymerization method, however, the binder resin has insufficient transparency for obtaining satisfactory sensitivity. Further, there arises a problem of smeared image in a high humidity environment due to attachment of corona discharge products or talc.

Other photoconductive substances widely known include inorganic substances, e.g., amorphous selenium, selenium alloys, cadmium sulfide, and zinc oxide; and organic substances, e.g., polyvinylcarbazole and derivatives thereof. The organic photoconductive substances are advantageous over inorganic ones in terms of transparency, film-forming properties, flexibility, and easy production. Lately, electrophotographic photoreceptors containing various photoconductive pigments in the photosensitive layer thereof have also been proposed as disclosed, e.g., in JP-A-57-176046, JP-A-57-176047, and JP-A-2-37356. Such pigment-containing photoreceptors are produced by coating a coating composition comprising a binder resin, e.g., polycarbonate resins and polyester resins, a photoconductive pigment, and an appropriate solvent on a conductive substrate by dip coating or a like coating technique and then removing the solvent by drying.

However, the electrophotographic photoreceptors using pigments so far proposed have insufficient photosensitivity and suffer from a reduction in charging properties or an increase in residual potential on long-term use and are therefore unsatisfactory for practical use.

According to the inventors' study, it has been elucidated that the above-mentioned disadvantages of the state-of-the-art electrophotographic photoreceptors arise from the following facts: (1) Because of existence of a binder resin having per se no photoconductivity in a photosensitive layer, movement of electric charges is inhibited. (2) Impurities originated in solvents or binder resins, particularly chlorides and metallic elements remain in a photosensitive layer, and these impurities act as trapping centers or undergo electrochemical reactions with a pigment or a conductive substrate on repeated use.

SUMMARY OF THE INVENTION

The present invention has been achieved for the purpose of eliminating the disadvantages associated with the conventional techniques.

An object of the present invention is to provide an electrophotographic photoreceptor having excellent durability, high sensitivity, and satisfactory image quality retention even in a high humidity environment.

Another object of the present invention is to provide an electrophotographic photoreceptor containing a pigment, which has high sensitivity and high durability.

The inventors have found that the above objects of the present invention are accomplished by a photosensitive layer containing a high polymeric compound comprising a repeating unit comprised of a tetracarboxylic acid anhydride skeleton and a divalent organic group skeleton having an aromatic nucleus, the two skeletons being bonded via a nitrogen atom.

The present invention provides an electrophotographic photoreceptor comprising a conductive substrate having provided thereon a photoconductive layer, said photoconductive layer contains a high polymeric compound comprising a repeating unit comprised of a tetracarboxylic acid anhydride skeleton and a divalent organic group skeleton having an aromatic nucleus, said two skeletons being bonded via a nitrogen atom.

BRIEF DESCRIPTION OF THE DRAWINGS

FIG. 1 illustrates a schematic view of a vacuum deposition polymerization apparatus which can be used in the present invention.

DETAILED DESCRIPTION OF THE INVENTION

The tetracarboxylic acid anhydride skeleton which constitutes a repeating unit of the high polymeric compound according to the present invention includes a perylene skeleton and a bisphthalic acid anhydride skeleton. The repeating unit comprised of such a tetracarboxylic acid anhydride skeleton and a divalent organic group skeleton having an aromatic nucleus includes those represented by formula (I) or (II):

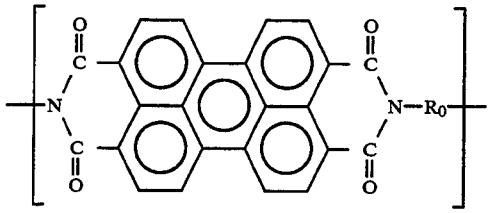

(I)

wherein $R_0$ represents a divalent organic group having an aromatic nucleus.

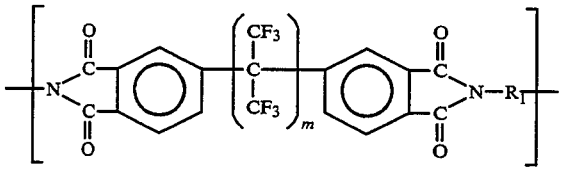

(II)

wherein $R_1$ represents a divalent organic group having an aromatic nucleus; and m represents an integer of from 1 to 3.

The divalent organic group having an aromatic nucleus as represented includes:

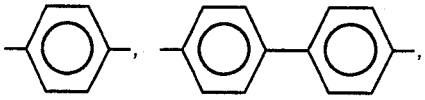

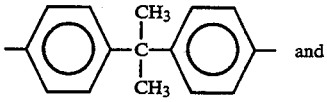

and

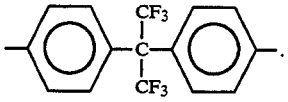

The high polymeric compounds having a perylene skeleton or bisphthalic anhydride skeleton can be formed by co-deposition of a perylenetetracarboxylic acid anhydride compound or a bisphthalic anhydride compound, respectively, and an aromatic diamine compound in the same reaction vessel.

Examples of perylenetetracarboxylic acid anhydride compounds include perylenetetracarboxylic acid anhydride of formula (III):

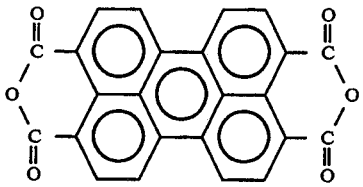

(III)

Examples of bisphthalic anhydride compounds include compounds of formula (IV):

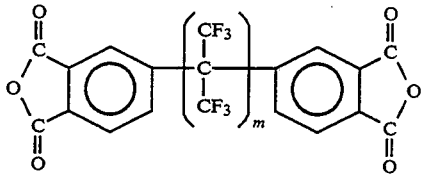

(IV)

wherein m is as defined above.

Specific examples of the bisphthalic anhydride compounds of formula (IV) are shown below.

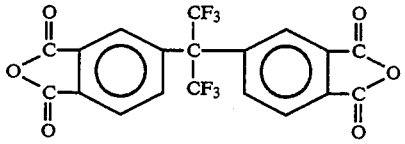

(IV-1)

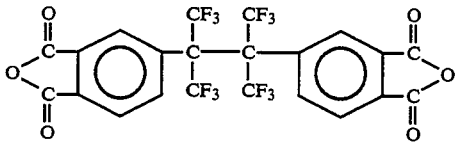

(IV-2)

Examples of the aromatic diamine compounds include compounds of formula (V):

$$H_2N—R_5—NH_2 \quad (V)$$

wherein $R_5$ represents a divalent organic group having an aromatic nucleus.

Examples of the divalent organic group as represented by $R_5$ are the same as those described above.

Specific examples of the aromatic diamine compounds of formula (V) are shown below.

(V-1)

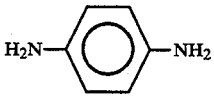

(V-2)

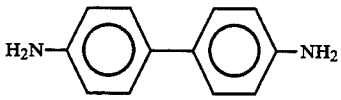

(V-3)

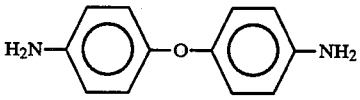

(V-4)

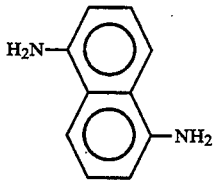

(V-5)

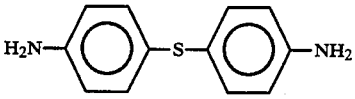

-continued (V-6)

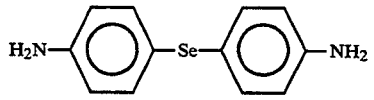

(V-7)

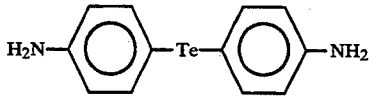

Specific examples of the high polymeric compound of the present invention are shown below.

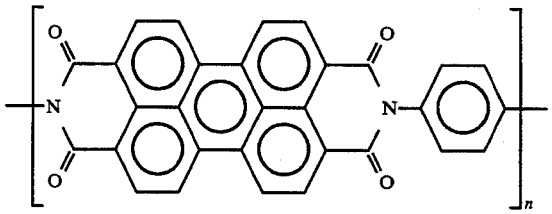

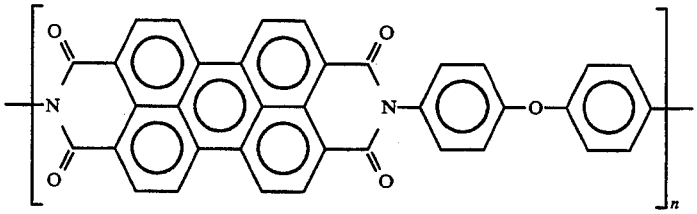

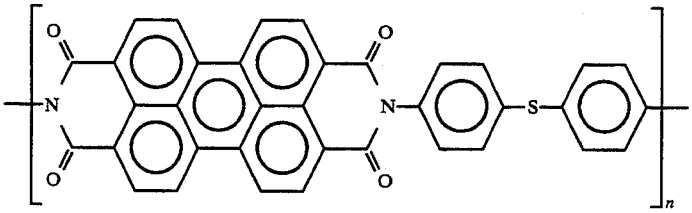

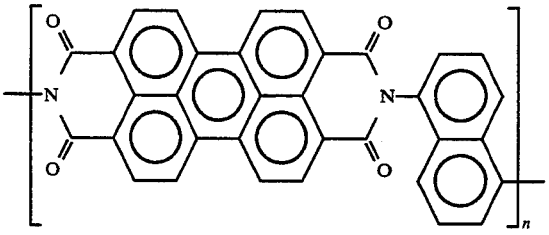

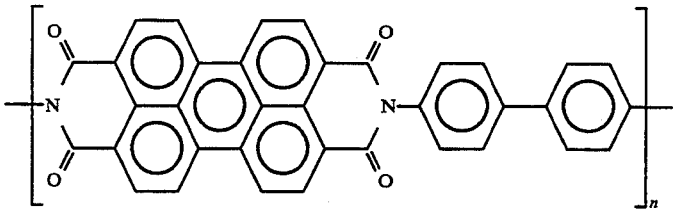

In the above structural formulae, n represents a degree of polymerization.

The high polymeric compound comprising the repeating unit of formula (I) or formula (II) preferably has dispersed therein a charge transporting material. Particularly, it is preferred that the high polymeric compound comprising the repeating unit of formula (II) has dispersed therein a charge transporting material.

The charge transporting material which is dispersed in the high polymeric compound of the present invention preferably includes benzidine compounds represented by formula (VI):

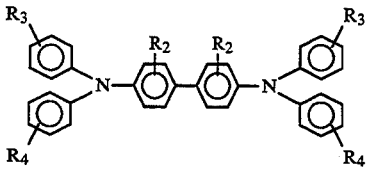

(VI)

wherein $R_2$ represents a hydrogen atom, an alkyl group, or an alkoxy group; $R_3$ represents a hydrogen atom, an alkyl group, a halogen atom, an alkoxycarbonyl group, or a substituted amino group; and $R_4$ represents an alkyl group, an alkoxy group, a halogen atom, an alkoxycarbonyl group, or a substituted amino group.
Specific examples of the benzidine compounds of formula (VI) are shown below.
(VI-1)
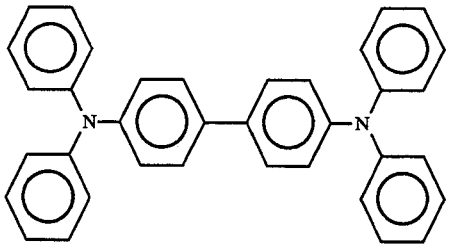
(VI-2)
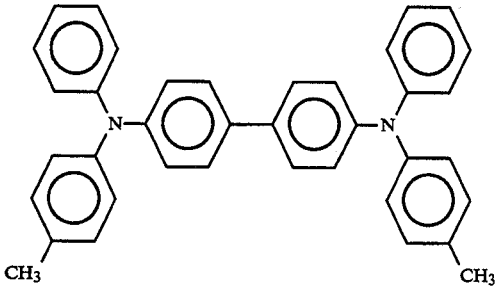
(VI-3)
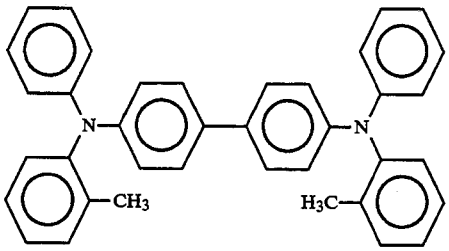
(VI-4)
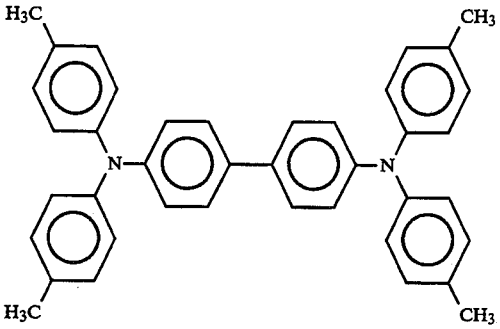
(VI-5)
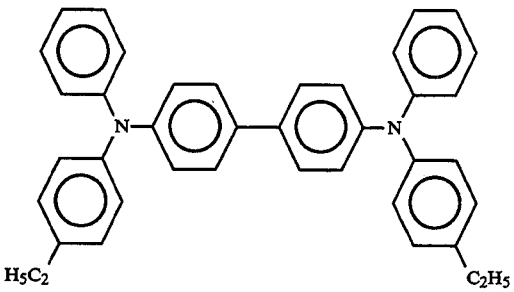
-continued
(VI-6)
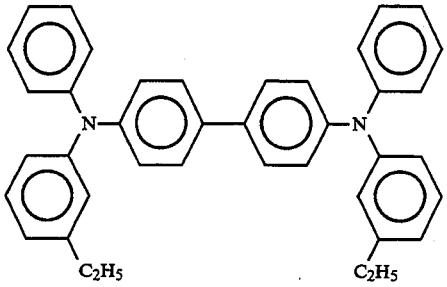
(VI-7)
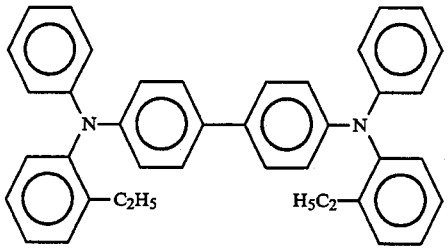
(VI-8)
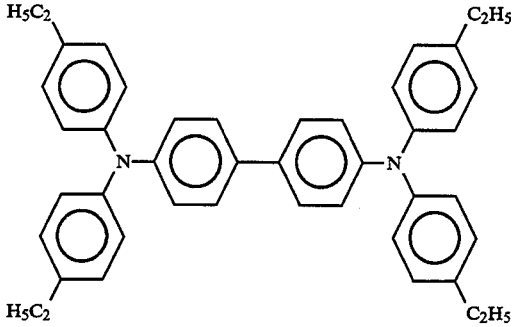
(VI-9)
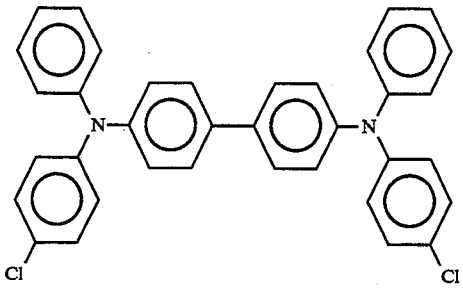
(VI-10)
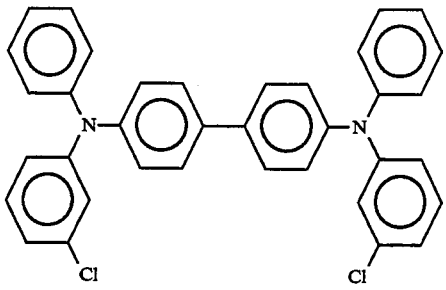

-continued
(VI-11)
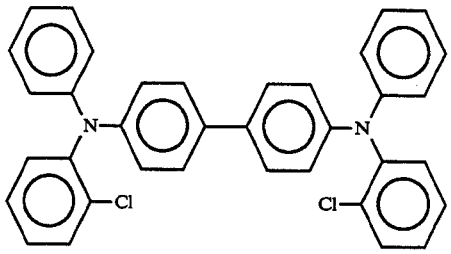
(VI-12)
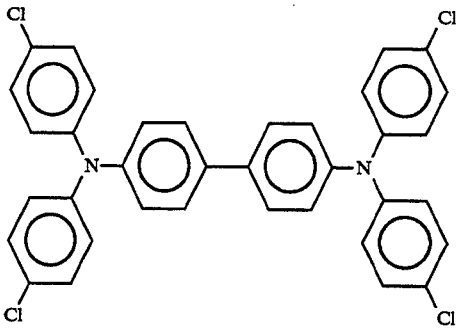
(VI-13)
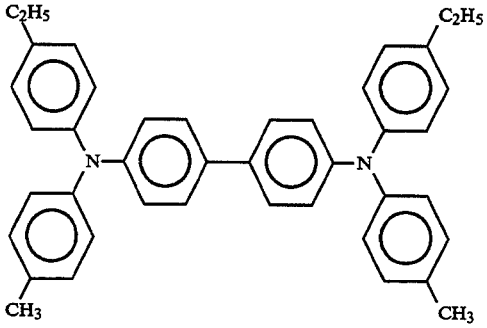
(VI-14)
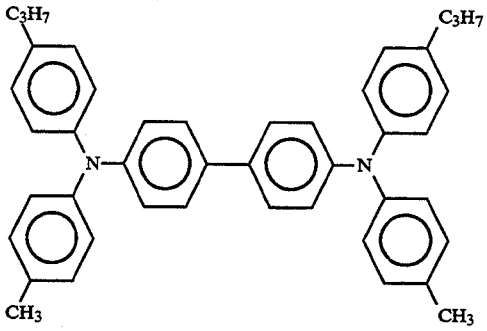
(VI-15)
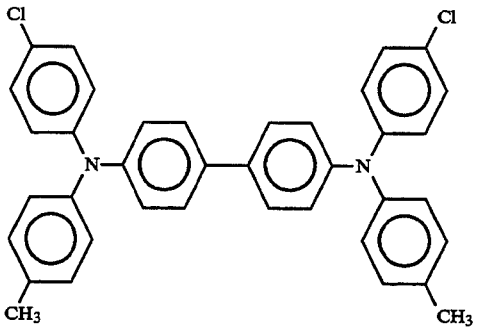
-continued
(VI-16)
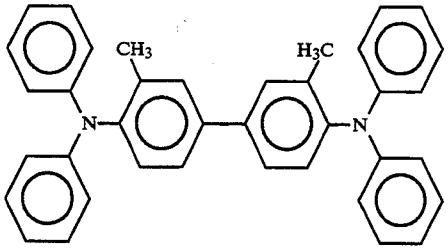
(VI-17)
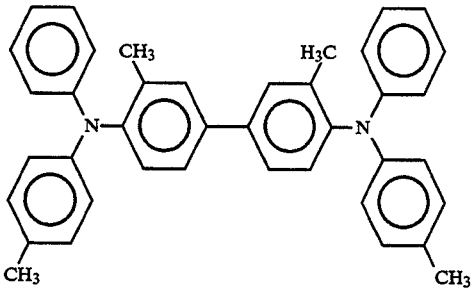
(VI-18)
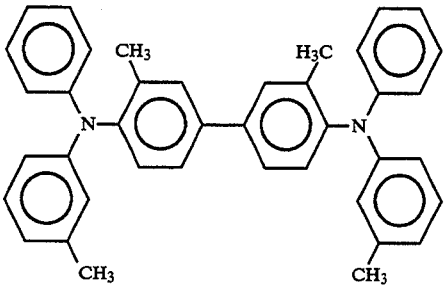
(VI-19)
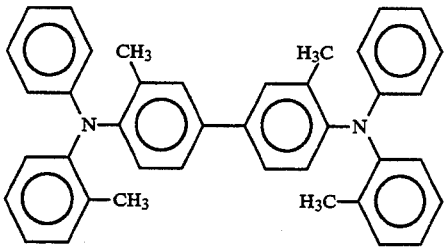
(VI-20)
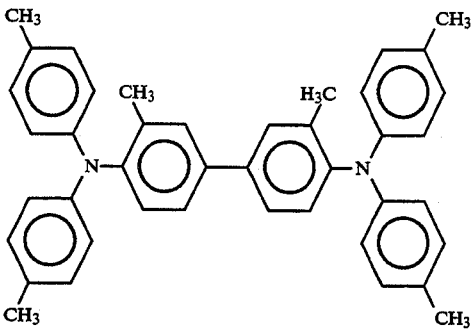

-continued
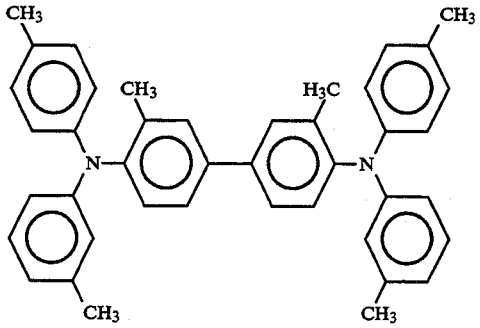
(VI-21)
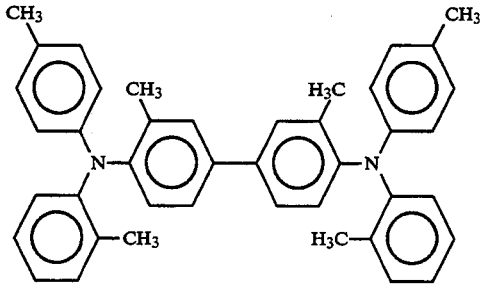
(VI-22)
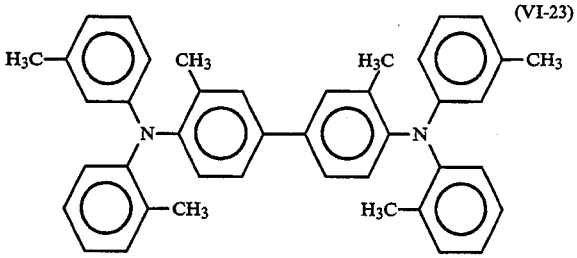
(VI-23)
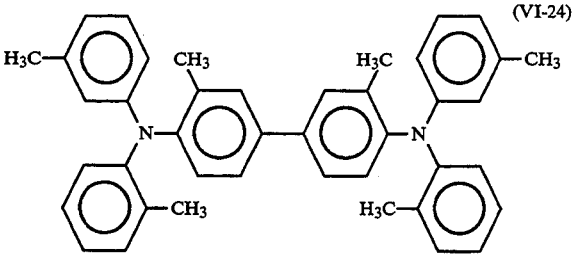
(VI-24)
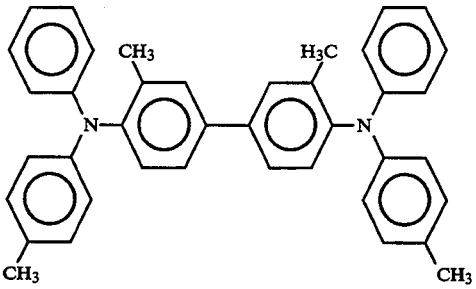
(VI-25)
-continued
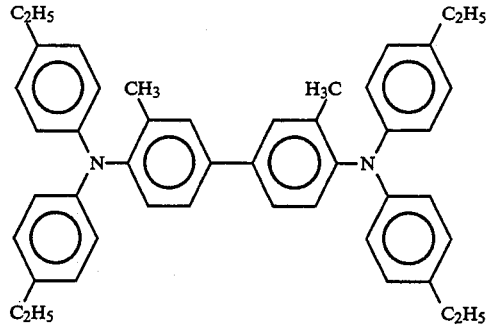
(VI-26)
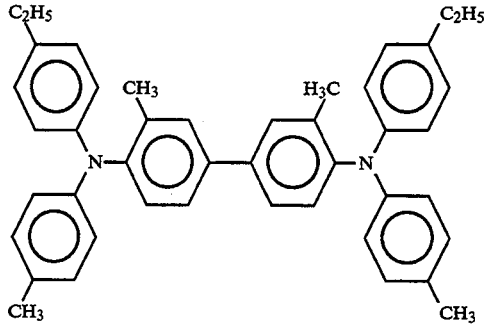
(VI-27)
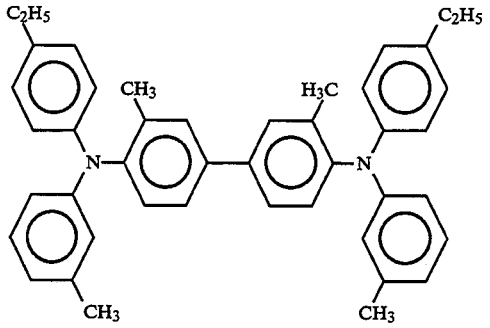
(VI-28)
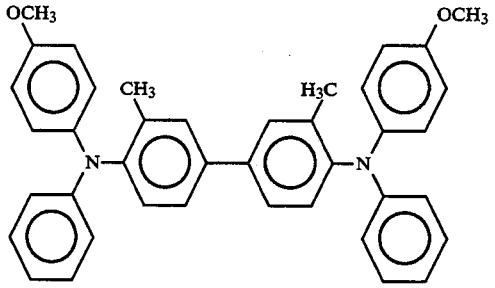
(VI-29)
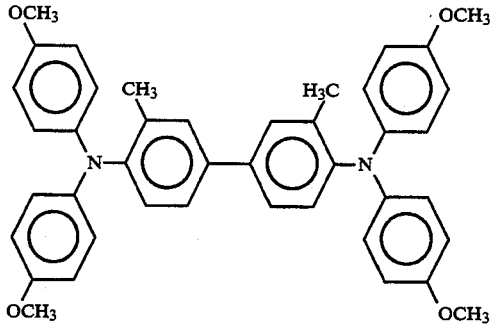
(VI-30)

-continued
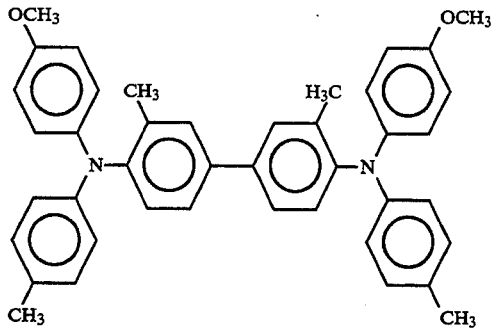
(VI-31)
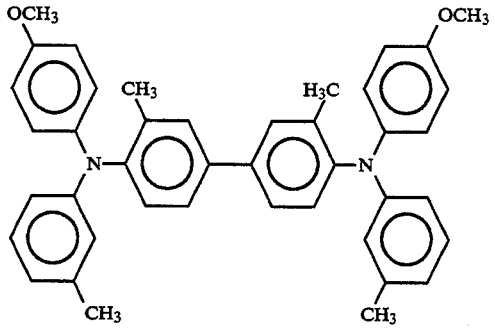
(VI-32)
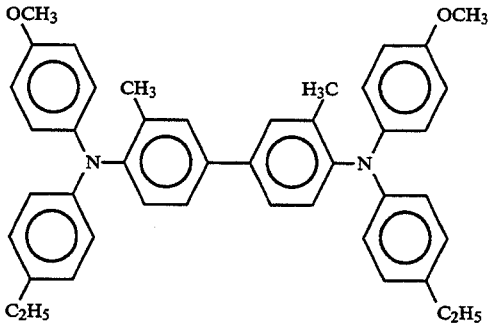
(VI-33)
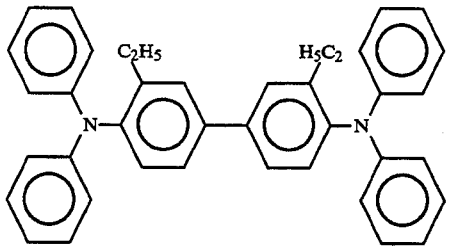
(VI-34)
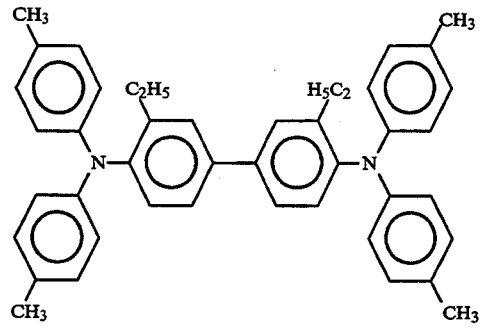
(VI-35)
-continued
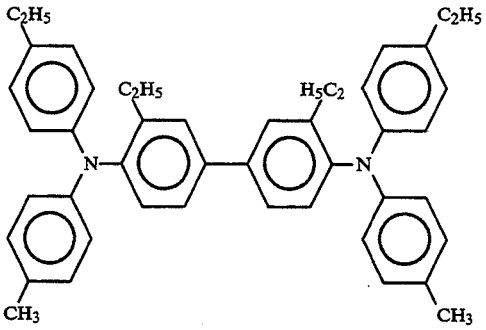
(VI-36)
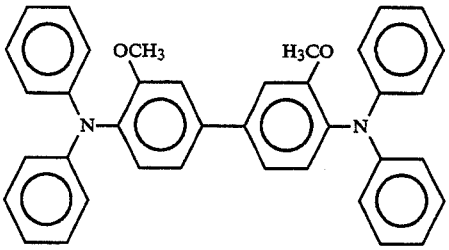
(VI-37)
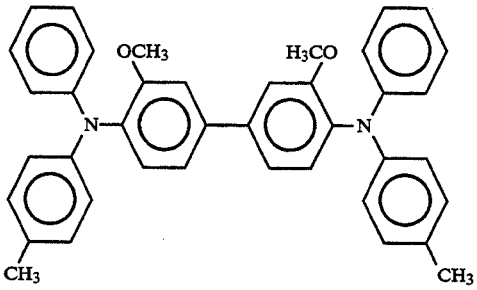
(VI-38)
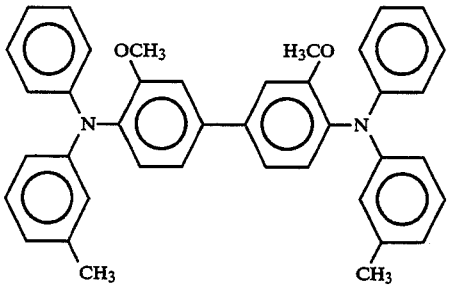
(VI-39)
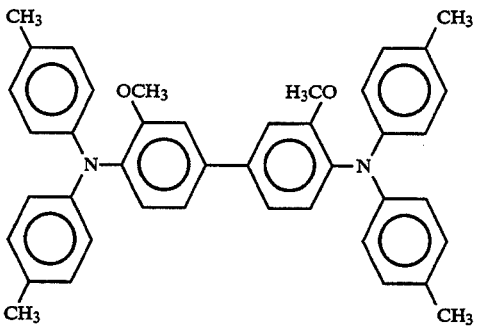
(VI-40)

-continued
(VI-41)
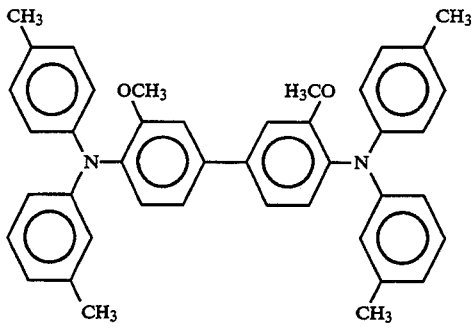
(VI-42)
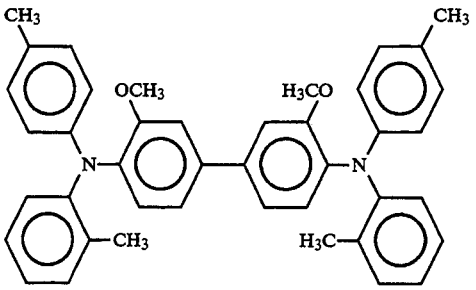
(VI-43)
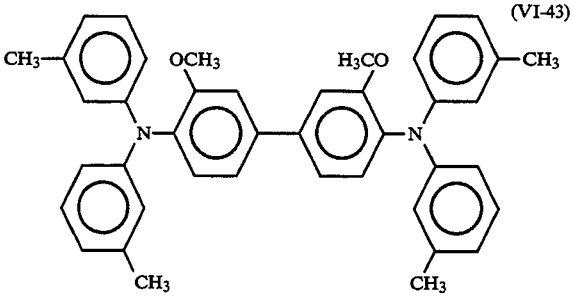
(VI-44)
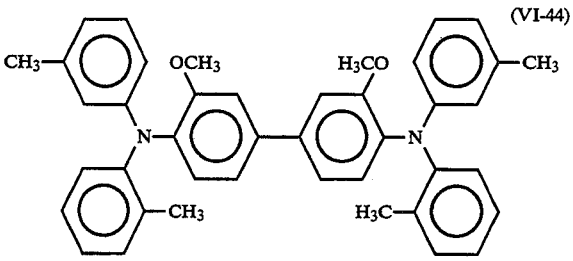
(VI-45)
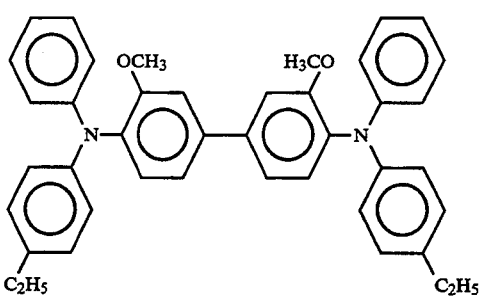
-continued
(VI-46)
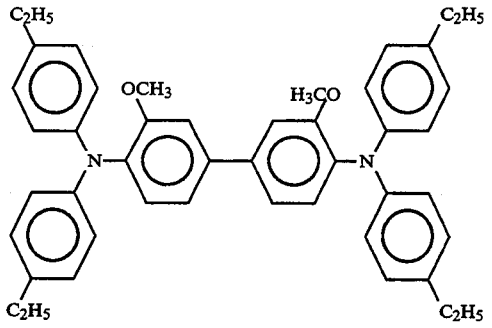
(VI-47)
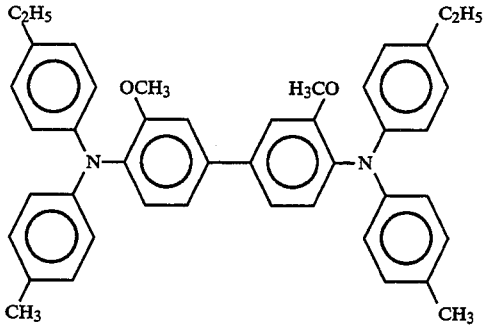
(VI-48)
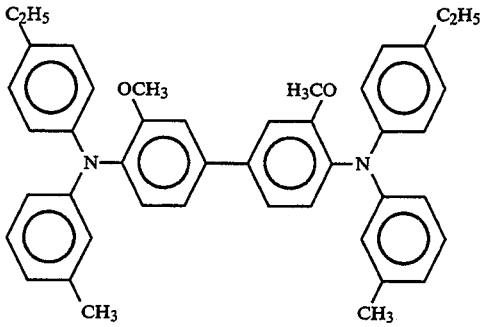
(VI-49)
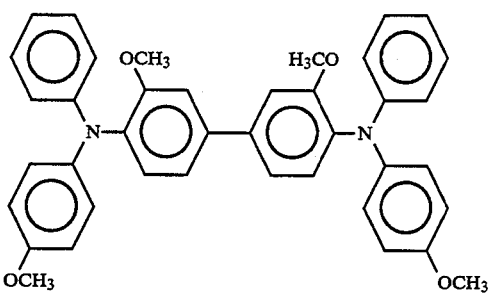
(VI-50)
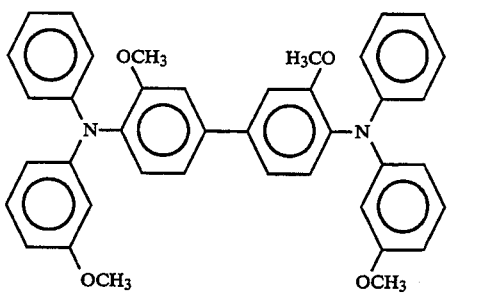

-continued

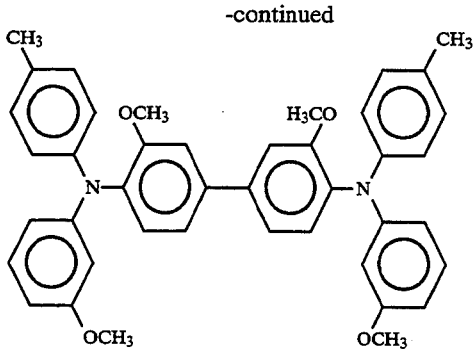

(VI-51)

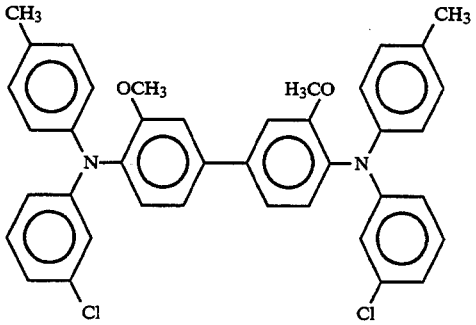

(VI-52)

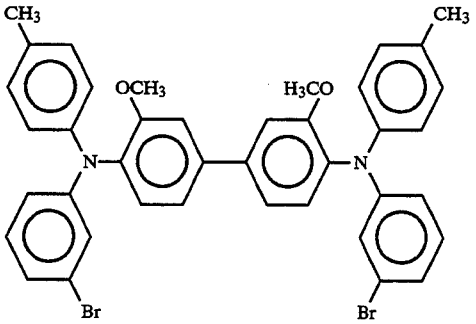

(VI-53)

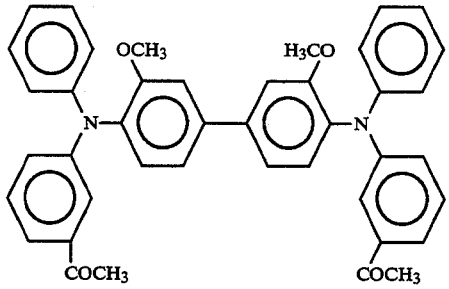

(VI-54)

In order to obtain satisfactory photosensitivity and excellent stability against repeated use, an electrophotographic photoreceptor is required to satisfy the following performance properties:

(1) Charge carriers be generated efficiently.

(2) Charge carriers generated be transported efficiently.

(3) No electrochemical reaction takes place in the photosensitive layer or on the interface thereof on repeated use, particularly in a high humidity environment.

In view of these requirements, the electrophotographic photoreceptor according to the present invention exhibits excellent photosensitivity and stability in charging properties and sensitivity on repeated use probably on account of the following reasons:

(a) In the high polymeric compound containing a perylene skeleton in the main chain thereof, e.g., the compound comprising the repeating unit of formula (I), the skeleton of a perylene pigment which is a charge generating material essentially having charge transporting properties is connected together via one or two phenyl nuclei. Therefore, the high polymeric compound allows easy transportation of electric charges within the molecule thereof.

(b) By adopting a vacuum deposition polymerization method, a photosensitive layer can be formed without using a binder resin essentially possessing no photoconductivity.

(c) By adopting a vacuum deposition polymerization method, a photosensitive layer can be formed without being accompanied by incorporation of impurities, such as chlorides and metallic elements, which are harmful to photoconductive properties, particularly stability on repeated use.

(d) In general, aromatic polyimide resins are excellent in mechanical strength and stability to oxidation and, when used as binder resins of a charge transporting layer, improve durability and abrasion resistance. The particular aromatic polyimide resin comprising the repeating unit of formula (II) is excellent in transparency and water repellency as well. When it is used as a binder resin of a charge transporting layer, there is formed a photosensitive layer which has high photosensitivity and is protected from attachment of corona discharge products, talc, or other impurities even on repeated use in a high temperature and high humidity environment and thereby exhibits excellent image quality retention.

The electrophotographic photoreceptor of the present invention comprises a conductive substrate having formed thereon a single layer photoconductive layer or a laminate photoconductive layer having its functions separately exercised by a charge generating layer and a charge transporting layer. In the latter case, the order of the charge generating layer and charge transporting layer is not limited.

Conductive substrates which can be used in the present invention include metal plates or drums made of aluminum, nickel, chromium, stainless steel, etc.; synthetic resin films having thereon a metallic foil or other thin films of conductive substances, e.g., metals; and paper or synthetic resin films having coated thereon or impregnated therein a conductivity-imparting agent.

Typical methods for forming a photoconductive layer used in the present invention are described below.

The photoconductive layer may comprise a high polymeric compound having a perylene skeleton in the main chain thereof and comprising the repeating unit of formula (I). The layer can be formed by vacuum deposition polymerization of perylenetetracarboxylic acid anhydride of formula (III) and an aromatic diamine compound of formula (V) usually to a degree of polymerization of from 10 to 50.

Alternatively, the photoconductive layer may be formed by vacuum deposition of a bisphthalic anhydride compound of formula (IV), an aromatic diamine compound of formula (V), and optionally a charge transporting material, e.g., a benzidine compound of formula (VI) while conducting copolymerization of the bisphthalic anhydride compound and aromatic diamine compound. The thus formed resin is excellent in transparency, abrasion resistance, corona resistance, and water repellency and is assumed to have a degree of polymerization of from 5 to 50.

The charge generating layer may also be formed by deposition of a charge generating material on a conductive substrate or by coating a coating composition mainly comprising a charge generating material and a binder resin. In this case, any of known charge generating materials and binder resins can be utilized. Examples of useful charge generating materials include inorganic semi-conductors (e.g., tri-Se), organic semi-conductors (e.g., polyvinylcarbazole), and organic pigments, e.g., bisazo compounds, trisazo compounds, phthalocyanine compounds, pyrylium compounds, and squarylium compounds. Examples of useful binder resins include polystyrene, silicone resins, polycarbonate resins, acrylic resins, methacrylic resins, polyester resins, vinyl polymers, cellulose derivatives, and alkyd resins.

The charge generating layer usually has a thickness of from about 0.05 to 10 μm, preferably 0.01 to 5 μm, more preferably 0.1 to 1 μm.

A charge transporting layer may also be formed from other charge transporting materials and binder resins. Examples of useful charge transporting materials are shown below, in addition to the benzidine compounds of formula (VI) of the present invention.

Pyrazoline Derivatives:

1)

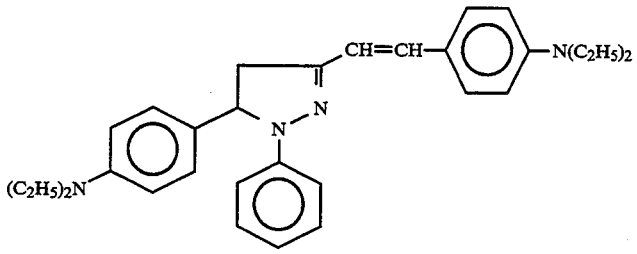

2)

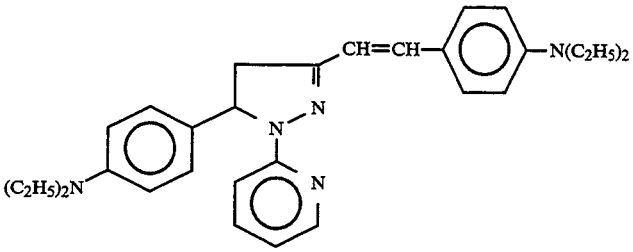

Hydrazone Derivatives:

1)

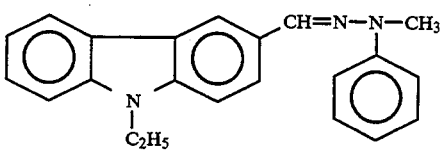

2)

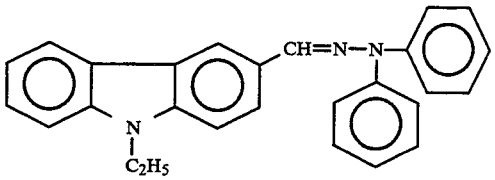

3)

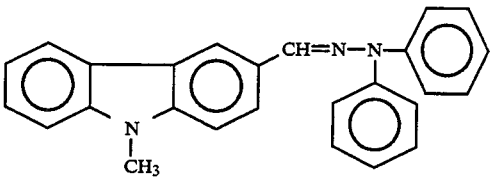

4)

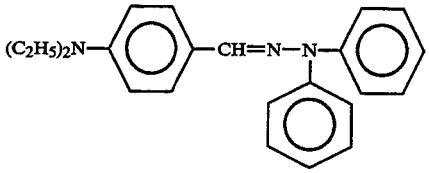

-continued
5)
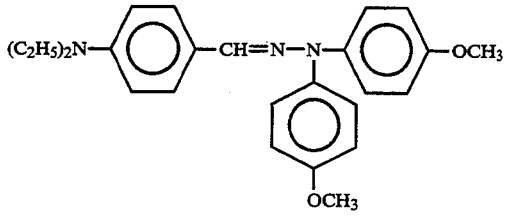
6)
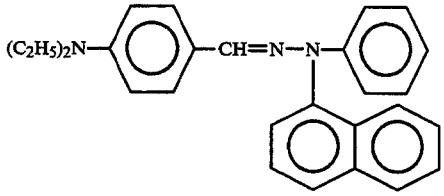
7)
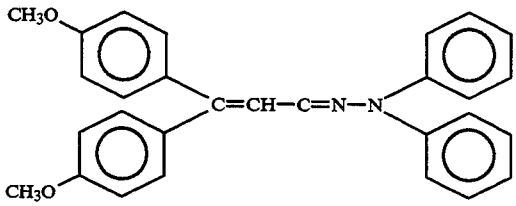
8)
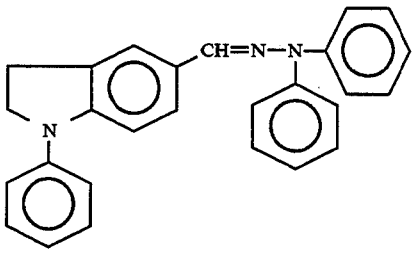
9)
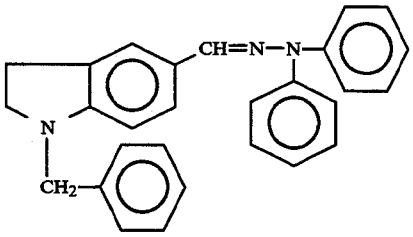
10)
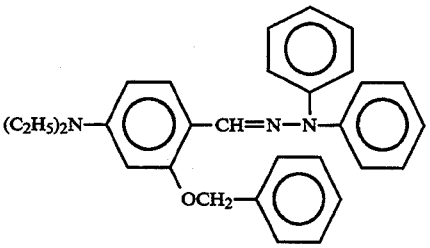

-continued
11)
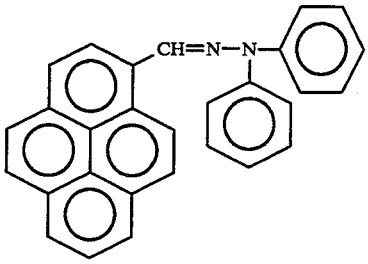
12)
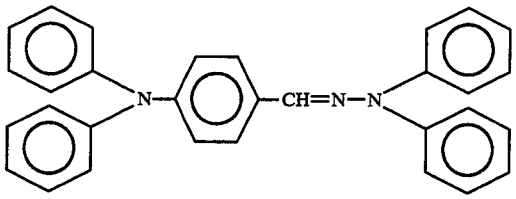
13)
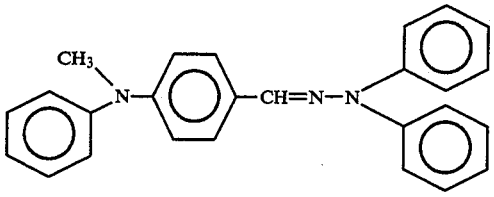
14)
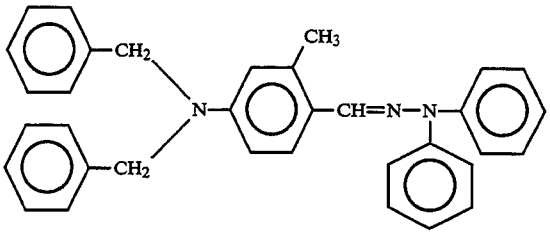
Oxazole Derivatives:
1)
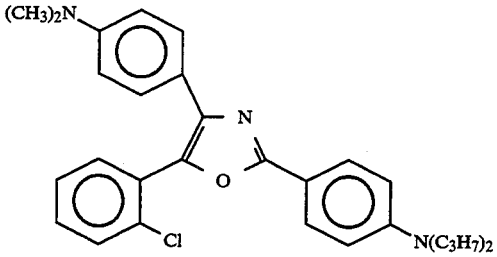
2)
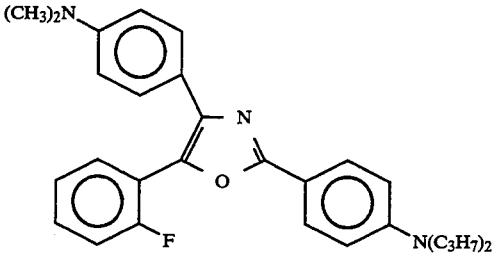
3)
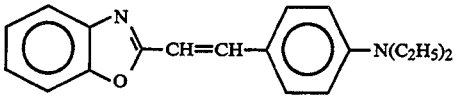
Oxadiazole Derivatives:

-continued
1)
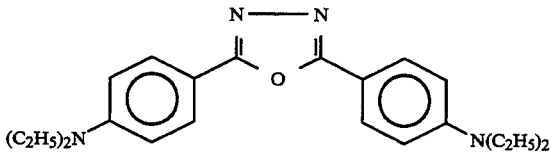
2)
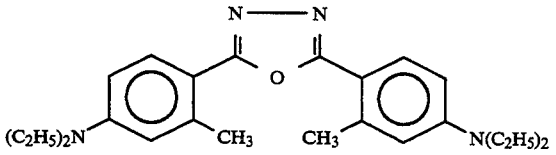
3)
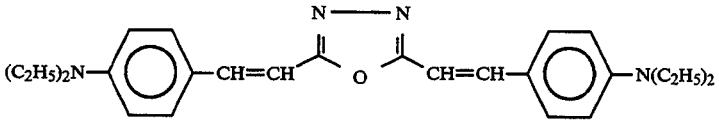
Arylalkane Compounds:
1)
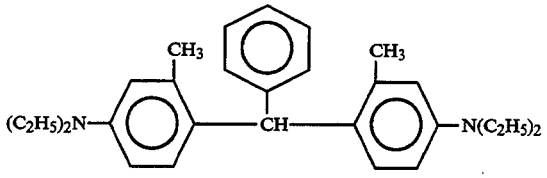
2)
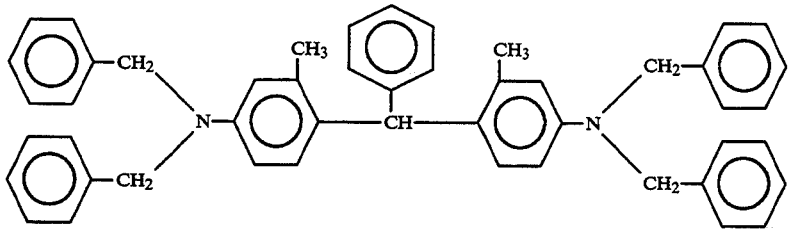
3)
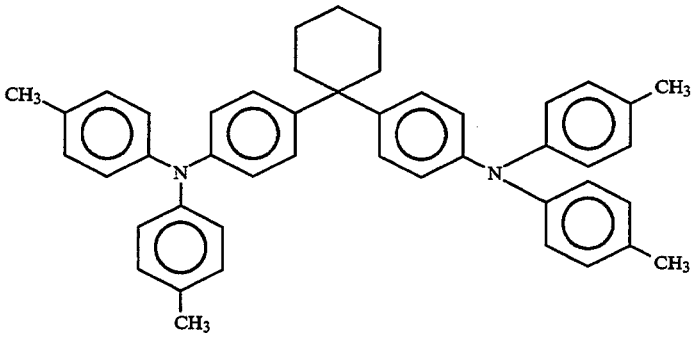
Triphenylamine Compounds:
1)
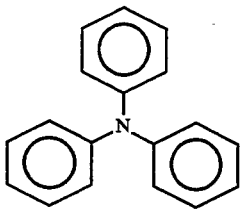

-continued
2)
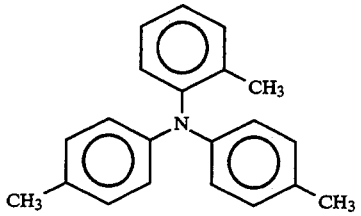
3)
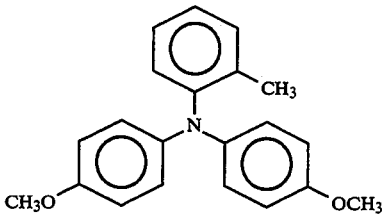
4)
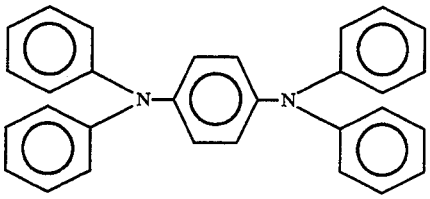
Aryl-Substituted Ethylene Compounds:
1)
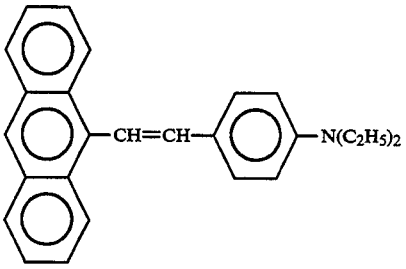
2)
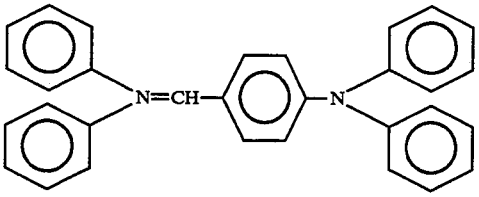
3)
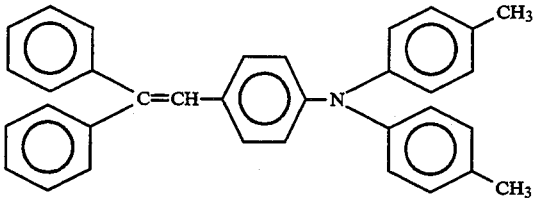
4)
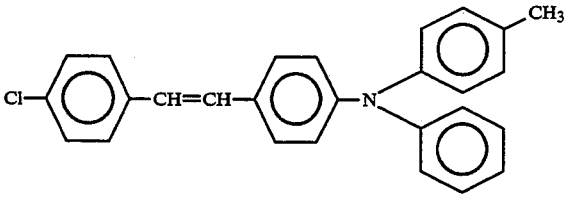

-continued
5)
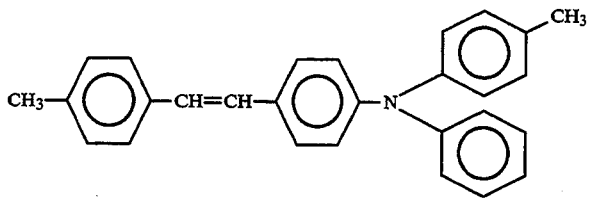
6)
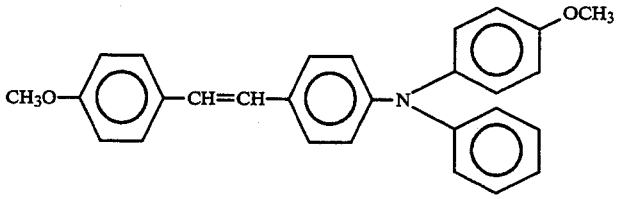
7)
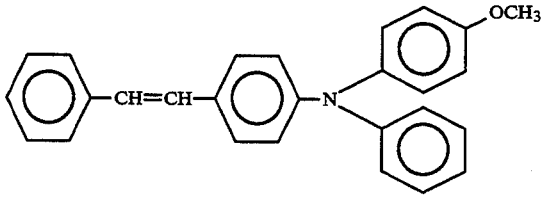
8)
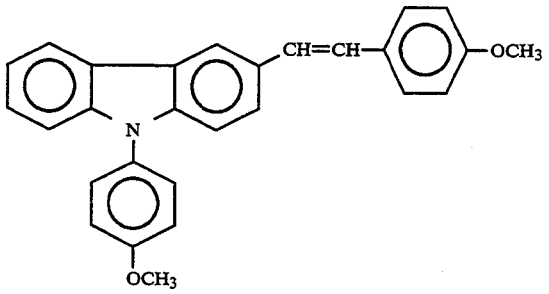
9)
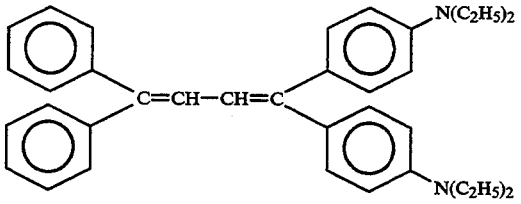
10)
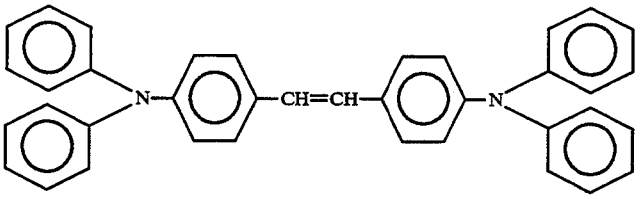
11)
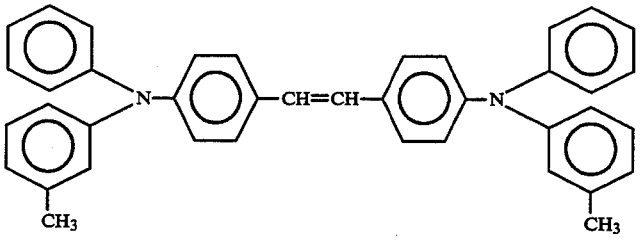

-continued
12)
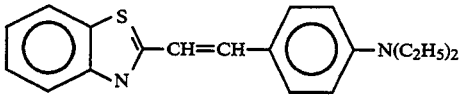
13)
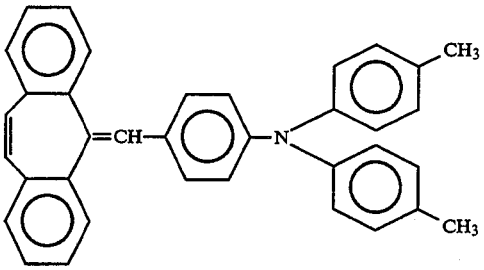
Bicarbazil Compounds:
1)
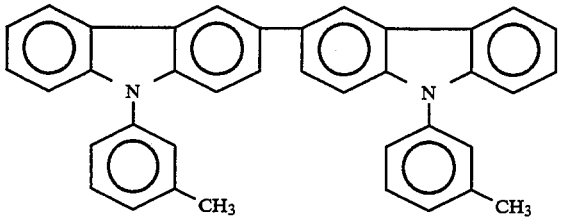
2)
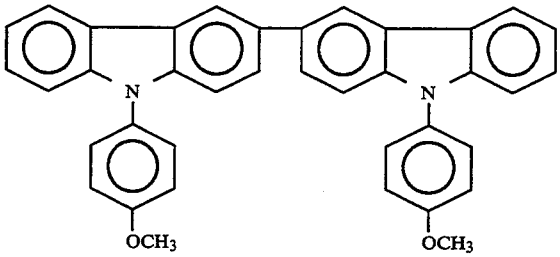
3)
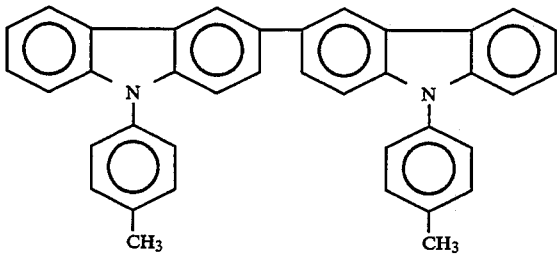
4)
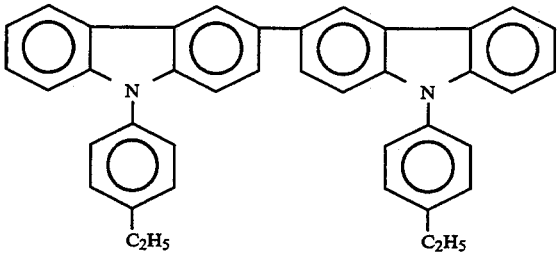

-continued

5)

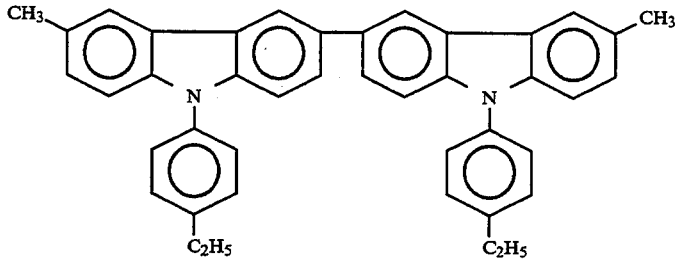

6)

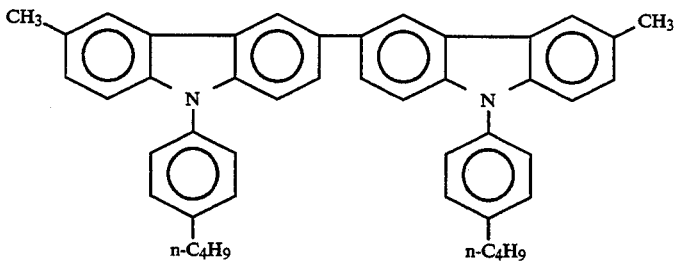

7)

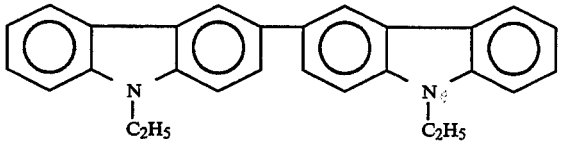

Since these charge transporting materials have per se no film-forming properties, they are used in combination with binder resins having satisfactory film-forming properties. Examples of useful film-forming binder resins are polycarbonate resins, polyacrylate resins, polyester resins, polystyrene, a styrene-acrylonitrile copolymer, polysulfone, polymethacrylic esters, and a styrene-methacrylate copolymer.

The charge transporting layer usually has a thickness of from 5 to 50 μm.

The high polymeric compound of the present invention may be present in either of a charge generating layer or a charge transporting layer. When the tetracarboxylic acid anhydride skeleton is a perylene skeleton, it is preferred that the high polymeric compound is present in the charge generating layer as a charge generating material. Further, when the tetracarboxylic acid anhydride skeleton is a bisphthalic anhydride skeleton, it is preferred that the high polymeric compound is present in the charge transporting layer. If the high polymeric compound is used in the charge generating layer as a charge generating material, other charge generating materials are unnecessary for the charge generating layer.

When the photoconductive layer of the present invention is a single layer structure, the layer thickness is preferably from 5 to 50 μm.

Vacuum deposition polymerization for formation of a photoconductive layer is explained below by referring to the accompanying drawing.

FIG. 1 illustrates a schematic view of an apparatus for vacuum deposition polymerization. Vacuum chamber 1 has evaporation boats 3 and 4 which can be heated by respective evaporation heaters 9 and 10 and in which evaporation sources A and B are placed. In vacuum chamber 1 are also set evaporation boats 5 and 6 in which evaporation sources C and D are placed, respectively, and which are each connected to electrical powers 7 and 8. Shutters 11 and 12 are set above evaporation boats 3 and 4, respectively. Base 2 which can be heated by heater 13 is set above the evaporation sources, on which a conductive substrate is mounted. The bottom of vacuum chamber 1 is connected to evacuation apparatus 15 via high vacuum valve 14. Inert gas (e.g., nitrogen) bomb 17 is connected to vacuum chamber 1 through gas introduction valve 16. The numeral 18 indicates a deposit thickness monitor.

In one of embodiments of vacuum deposition, perylenetetracarboxylic acid anhydride of formula (III) is put in one of the evaporation boats, and an aromatic diamine compound of formula (V) is put in the other boat. After diminishing the pressure in vacuum chamber 1 to a prescribed pressure, each evaporation source is heated to a respective prescribed temperature to be deposited on a conductive substrate mounted on base 2. Then, an inert gas, e.g., nitrogen, is introduced into the vacuum chamber, and the conductive substrate is heated to a prescribed temperature to complete polymerization of the deposited substances.

Vacuum deposition is carried out at a degree of vacuum of from $10^{-4}$ to $10^{-7}$ Torr and at a substrate temperature of from room temperature to 100° C., and preferably from room temperature to 50° C. For polymerization, the substrate is suitably heated to a temperature ranging from 150° to 350° C.

In another embodiment of vacuum deposition, a bisphthalic anhydride compound of formula (IV) is put in one of the evaporation boats, and an aromatic diamine compound of formula (V) is put in the other boat. Further, a benzidine compound of formula (VI) is put in evaporation boat 5 or 6. After evacuating vacuum chamber 1 to $10^{-4}$ to $10^{-7}$ Torr, the evaporation sources are heated to a respective prescribed temperature to conduct vacuum evaporation onto a conductive substrate mounted on base 2 whereby the bisphthalic anhydride compound and the aromatic diamine compound undergo dehydrating condensation to form a high polymer film having uniformly dispersed therein the benzidine compound. The temperature of base 2 may be heated to 40° to 100° C. during the reaction. Then, the thus formed high polymer film is subjected to annealing in vacuo or in a nitrogen gas at 150° to 250° C. to form a charge transporting layer comprising an aromatic polyimide resin comprised of the repeating unit of formula (II) having uniformly dispersed therein the benzidine compound. The charge transporting layer preferably has a thickness of from about 5 to 50 μm.

It is preferable to provide a barrier layer on the conductive substrate. A barrier layer is effective to prevent injection of unnecessary charges from the conductive substrate thereby improving charging properties of the photosensitive layer or improving image quality. A barrier layer is also effective to improve adhesion of a conductive substrate.

Materials for constituting such a barrier layer are polyvinyl alcohol, polyvinylpyrrolidone, polyvinylpyridine, cellulose ethers, cellulose esters, polyamide, polyurethane, casein, gelatin, polyglutamic acid, starch, starch acetate, aminostarch, polyacrylic acid salts, polyacrylamide, silane coupling agents, zirconium chelates, and titanium chelates. These materials preferably have a resistivity of from $10^5$ to $10^{14}$ Ω·cm. The barrier layer usually has a thickness of from about 0.01 to 2 μm.

The present invention is now illustrated in greater detail with reference to Examples, but it should be understood that the present invention is not deemed to be limited thereto. All the percents, parts, and ratios are by weight unless otherwise indicated.

EXAMPLE 1

A photoconductive layer composed of a charge generating layer and a charge transporting layer was formed under the following conditions by use of the vacuum deposition polymerization apparatus shown in FIG. 1.

Two parts of perylenetetracarboxylic acid anhydride of formula (1) shown below and 2 parts of p-phenylenediamine of formula (2) shown below were put in evaporation boats 3 and 4 as evaporation sources A and B, respectively. An aluminum sheet was mounted on base 2, and the vacuum chamber was evacuated to $10^{-6}$ Torr. Base 2 was heated to 60° C. by heater 13, and evaporation sources A and B were heated to 350° C. and 150° C. by heaters 9 and 10, respectively. On reaching the respective temperature, shutters 11 and 12 were opened to commence vacuum deposition. When the deposit thickness reached 0.5 μm (detected with monitor 18), the shutters were closed, and heating by heaters 9 and 10 was stopped. Valve 16 was opened to slowly let in nitrogen gas. When the inner pressure reached about 0.5 atom, the deposited film was heated to 250° C. by heater 13 and kept at that temperature for 1 hour to form a 0.5 μm thick charge generating layer comprising a high polymeric compound comprising a repeating unit of formula (3) shown below.

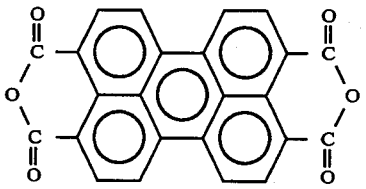

(1)

-continued

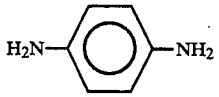

(2)

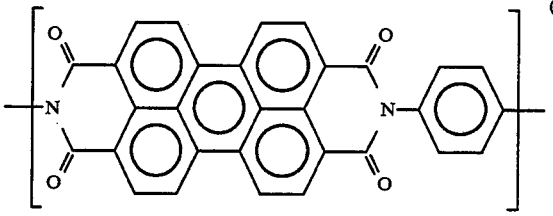

(3)

A uniform solution consisting of 1 part of N,N'-diphenyl-N,N-bis(3-methylphenyl)-[1,1-biphenyl]-4,4'-diamine, 1 part of a polycarbonate resin "Panlite" (produced by Teijin Limited), and 10 parts of tetrahydrofuran was coated on the thus formed charge generating layer with a bar coater and dried to form a 15 μm thick charge transporting layer.

The resulting electrophotographic photoreceptor was evaluated as followed by use of an electrostatic copying paper analyzer "EPA-8100" (manufactured by Kawaguchi Seisakusho K.K.).

The photoreceptor was negatively charged with a corona discharge to −6 kV and allowed to stand in dark for 2 seconds. The initial surface potential at this time ($V_{PO}$) was measured. Then, the photoreceptor was exposed to light emitted from a tungsten lamp at an illuminance of 5 lux, and the time required for reducing the surface potential to half the initial surface potential $V_{PO}$ was measured to obtain an exposure amount $E_1/2$ (lux·sec). Further, the residual surface potential after 4 seconds from the exposure ($V_R$) was measured.

The charging and light exposure were repeated 200 times, and the above-described measurements were made on the 200th time.

The results obtained are shown in Table 1 below.

EXAMPLE 2

An electrophotographic photoreceptor was produced in the same manner as in Example 1, except for using 4,4'-diaminobiphenyl of formula (4) shown below in place of p-diphenylamine as evaporation source B. The results of evaluations are shown in Table 1.

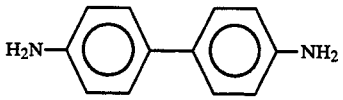

(4)

In 40 parts of cyclohexane was dissolved 1 part of a polyvinyl butyral resin "BLX" (produced by Sekisui Chemical Co., Ltd.), and 4 parts of the compound of formula (1) shown above (Comparative Example 1) or a compound of formula (5) shown below (Comparative Example 2) was mixed therewith, followed by thoroughly dispersing in a paint shaker. The resulting dispersion was coated on an aluminum sheet by means of an applicator and dried to form a 0.5 μm thick charge generating layer. A charge transporting layer was then formed thereon in the same manner as in Example 1 to prepare an electrophotographic photoreceptor.

The results of evaluations are shown in Table 1.

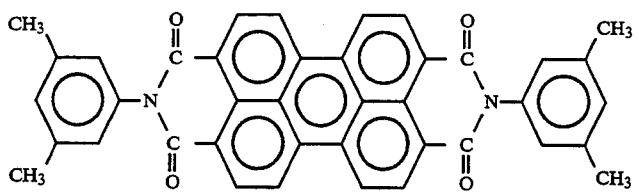

(5)

TABLE 1

| | 1st Measurement | | | 200th Measurement | | |
|---|---|---|---|---|---|---|
| | $V_{PO}$ (V) | $E_{\frac{1}{2}}$ (lux · sec) | $V_R$ (V) | $V_{PO}$ (V) | $E_{\frac{1}{2}}$ (lux · sec) | $V_R$ (V) |
| Example 1 | −750 | 1.5 | −7 | −740 | 1.5 | −10 |
| Example 2 | −780 | 1.8 | −10 | −770 | 1.9 | −15 |
| Comp. Example 1 | −770 | 3.5 | −100 | −820 | 4.0 | −200 |
| Comp. Example 2 | −800 | 2.0 | −20 | −830 | 2.3 | −60 |

EXAMPLE 3

The electrophotographic photoreceptor obtained in Example 1 was rolled around an aluminum pipe and set in an electrophotographic copying machine "FX-2700" (manufactured by Fuji Xerox Co., Ltd.). After charging and exposure were repeated 5000 times at 35° C. and 85% RH, copies were obtained according to a usual electrophotographic process. As a result, it was confirmed that satisfactory images free from white dots, black dots or background stain were obtained.

Comparative Example 3

Copying was conducted in the same manner as in Example 3, except for using the electrophotographic photoreceptor prepared in Comparative Example 2. As a result, the copies suffered from white spots on the image area and black spots on the white background.

EXAMPLE 4

An electrophotographic photoreceptor composed of a charge generating layer and a charge transporting layer was formed under the following conditions by use of the vacuum deposition apparatus shown in FIG. 1.

Two parts of dibromoanthanthrone pigment, 20 parts of Compound (IV-1), 20 parts of Compound (V-3), and 10 parts of Compound (VI-2) were each put in evaporation boats 6, 3, 4, and 5 as evaporation sources D, A, B, and C, respectively. An aluminum sheet was mounted on base 2, and vacuum chamber 1 was evacuated to $10^{-6}$ Torr. Electric power source 8 was switched on to heat evaporation source D to 500° C. for evaporation. Vacuum deposition was conducted while monitoring the deposit thickness by monitor 18 to form a 0.5 μm thick charge generating layer.

Subsequently, base 2 was heated to 60° C. by heater 13, and evaporation sources A and B were heated to 150° C. by heaters 9 and 10. Power source 7 was switched on to heat evaporation source C to 150° C. to thereby conduct vacuum deposition. After evaporation for 100 minutes, nitrogen gas was slowly introduced into the vacuum chamber through valve 16 to an inner pressure of about 0.5 atom. The deposited film was then heated to 250° C. by heater 13 and kept at that temperature for 1 hour to form a 10 μm thick charge transporting layer.

The resulting electrophotographic photoreceptor was evaluated for its performance in the same manner as in Example 1. The results obtained in the 1st measurement are shown in Table 2.

EXAMPLE 5

An electrophotographic photoreceptor was produced in the same manner as in Example 4, except for using Compound (IV-2) in place of Compound (IV-1) as evaporation source A. The results of evaporations are shown in Table 2.

EXAMPLE 6

An electrophotographic photoreceptor was produced in the same manner as in Example 4, except for using Compound (VI-27) in place of Compound (VI-2) as evaporation source C. The results of evaporations are shown in Table 2.

EXAMPLE 7

An electrophotographic photoreceptor was produced in the same manner as in Example 6, except for using Compound (V-1) in place of Compound (V-3) as evaporation source B. The results of evaporations are shown in Table 2.

Comparative Example 4

An electrophotographic photoreceptor was produced in the same manner as in Example 4, except for using a compound of formula (6) shown below in place of Compound (IV-1) as evaporation source A. The results of evaporations are shown in Table 2.

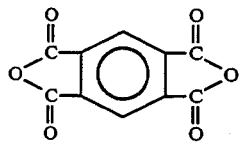

(6)

Comparative Example 5

An electrophotographic photoreceptor was produced in the same manner as in Comparative Example 4, except for using Compound (VI-27) in place of Compound (VI-2) as evaporation source C. The results of evaporations are shown in Table 2.

TABLE 2

| | $V_{PO}$ (V) | $E_{\frac{1}{2}}$ (lux · sec) |
|---|---|---|
| Example 4 | −615 | 2.3 |
| Example 5 | −580 | 1.9 |
| Example 6 | −595 | 2.1 |
| Example 7 | −605 | 2.3 |
| Comparative Example 4 | −630 | 6.9 |

TABLE 2-continued

| | $V_{PO}$ (V) | $E_{\frac{1}{2}}$ (lux · sec) |
|---|---|---|
| Comparative Example 5 | −645 | 6.5 |

EXAMPLE 8

The electrophotographic photoreceptor produced in Example 4 was rolled around an aluminum pipe and set in an electrophotographic copying machine "FX-2700". After charging and destatizing were repeated 15,000 times at 35° C. and 85% RH, copies were obtained according to a usual electrophotographic process. As a result, it was confirmed that satisfactory images free from smeare were obtained.

Comparative Example 6

Copies were obtained in the same manner as in Example 8, except for using the electrophotographic photoreceptor prepared in Comparative Example 4. As a result, the images obtained suffered from smear and background stain.

It can be seen-that the electrophotographic photoreceptors obtained in Examples 1 to 3 had high photosensitivity, excellent charging properties, small dark decay, small residual potential, and durability inclusive of stability of charged potential on repeated use. Further, where a charge generating layer is formed by vacuum deposition according to the present invention, it is possible to control impurities present in organic pigments during the deposition step. Accordingly, electrophotographic characteristics can be stabilized even when commercially available or non-treated organic pigments are used in the photoconductive layer.

In the electrophotographic photoreceptors obtained in Examples 4 to 8, since the charge transporting layer is comprised of a fluorine-containing aromatic polyimide resin formed by vacuum deposition, the photoconductive layer has satisfactory transparency, high photosensitivity and excellent abrasion resistance or durability. Accordingly, they are protected from attachment of impurities, such as corona discharge products or talc and never cause smeared image or background stain.

EXAMPLE 9

An electrophotographic photoreceptor was produced in the same manner as in Example 1, except for using 4,4'-thiodianiline of formula (7) shown below in place of p-diphenylamine as evaporation source B.

The resulting electrophotographic photoreceptor was evaluated for its performance in the same manner as in Example 1. The results obtained are shown below.

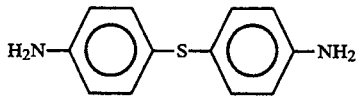

(7)

| 1st Measurement | | | 200th Measurement | | |
|---|---|---|---|---|---|
| $V_{PO}$ (V) | $E_{\frac{1}{2}}$ (lux · sec) | $V_R$ (V) | $V_{PO}$ (V) | $E_{\frac{1}{2}}$ (lux · sec) | $V_R$ (V) |
| −820 | 2.0 | −20 | −820 | 2.0 | −25 |

EXAMPLE 10

An electrophotographic photoreceptor of a single photoconductive layer structure was produced in the same deposition conditions as in Example 1, except for using perylenetetracarboxylic acid anhydride and 4,4'-thiodianiline as evaporation sources A and B, respectively and the deposit thickness was 10 μm.

The resulting electrophotographic photoreceptor was evaluated for its performance in the same manner as in Example 1. The results obtained are shown below.

| 1st Measurement | | | 200th Measurement | | |
|---|---|---|---|---|---|
| $V_{PO}$ (V) | $E_{\frac{1}{2}}$ (lux · sec) | $V_R$ (V) | $V_{PO}$ (V) | $E_{\frac{1}{2}}$ (lux · sec) | $V_R$ (V) |
| −600 | 2.0 | −40 | −630 | 2.3 | −50 |

While the invention has been described in detail and with reference to specific examples thereof, it will be apparent to one skilled in the art that various changes and modifications can be made therein without departing from the spirit and scope thereof.

What is claimed is:

1. An electrophotographic photoreceptor comprising a conductive substrate having provided thereon a photoconductive layer, wherein said photoconductive layer comprises a charge generating material, said charge generating material comprising a high polymeric compound wherein said high polymeric compound is a copolymer formed by vacuum deposition polymerizing a bisphthalic anhydride compound represented by formula (IV):

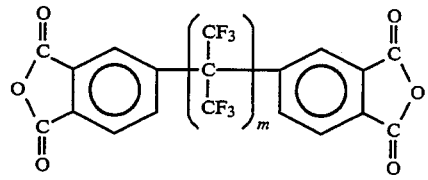

(IV)

wherein m represents an integer of from 1 to 3, and an aromatic diamine compound in the same reaction vessel.

* * * * *